United States Patent [19]

Tummolo

[11] 4,202,637

[45] May 13, 1980

[54] METHOD AND MACHINE FOR DRY CHARACTER TRANSFER

[75] Inventor: Mauro Tummolo, 241 Suydam St., Brooklyn, N.Y. 11237

[73] Assignee: Mauro Tummolo, Brooklyn, N.Y.

[21] Appl. No.: 851,348

[22] Filed: Nov. 14, 1977

[51] Int. Cl.[2] ..... B41J 3/28

[52] U.S. Cl. ..... 400/118; 427/147; 428/914; 101/1; 101/426; 400/240.3; 400/48; 400/31; 400/696; 400/697.1; 156/384; 156/230

[58] Field of Search ..... 156/230, 540; 400/696, 400/697.23, 697.1, 29, 36, 48, 118, 122, 240, 240.3, 31; 101/1, 33, 34, 426; 428/914; 427/147; 96/43

[56] References Cited

U.S. PATENT DOCUMENTS

| | | | |
|---|---|---|---|
| 3,215,245 | 11/1965 | Thiene et al. | 400/23 |
| 3,228,507 | 1/1966 | Young | 400/29 |
| 3,283,886 | 11/1966 | Addis et al. | 156/540 |
| 3,583,540 | 6/1971 | Bernard | 400/29 |
| 3,598,685 | 8/1971 | Lee et al. | 156/230 |
| 3,657,051 | 4/1972 | McCarthy | 156/230 |
| 3,702,585 | 11/1972 | Landis et al. | 101/1 |
| 3,942,621 | 3/1976 | Karlan | 400/697 |
| 3,943,023 | 3/1976 | Weingrad | 156/230 |
| 3,961,121 | 6/1976 | Warsager | 400/240.3 |
| 4,037,708 | 7/1977 | Walker-Arnott | 400/240.3 |

*Primary Examiner*—William Pieprz
*Attorney, Agent, or Firm*—G. H. Mortimer

[57] ABSTRACT

Method and machine for transferring specific ink designs, symbols, patterns, and characters in the form of the alphabet quickly and precisely from a tape onto the surface of an object. This is accomplished by moving said tape, back and forth to a desired character or symbol. Then, by applying a light rubbing pressure, the character or symbol is transferred from the tape and printed onto the paper beneath it. Each time the transfer occurs, the plate and paper are moved relative to each other automatically, a set amount of space from right to left. Thus, one can print a whole line of words formed by the characters. By moving the plate and tape relative to each other, other lines of words can be printed.

17 Claims, 11 Drawing Figures

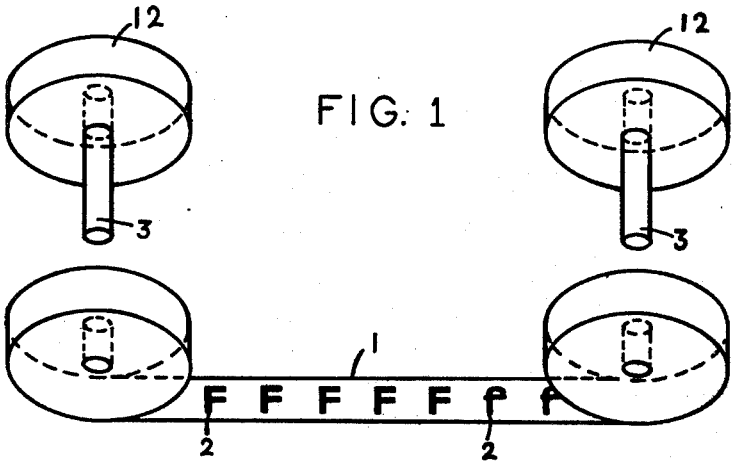
FIG. 1
FIG. 2
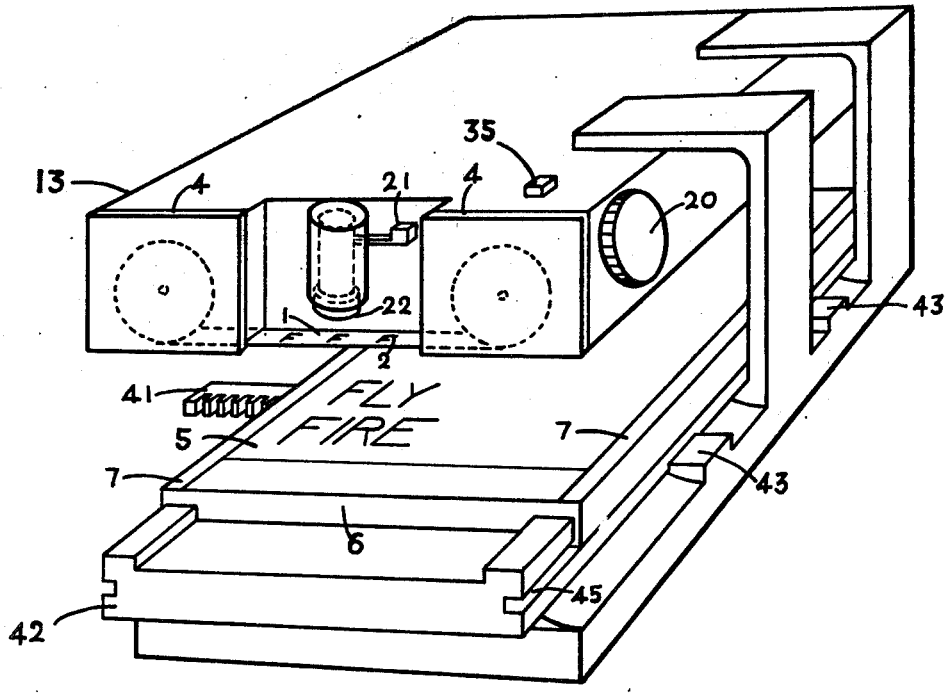

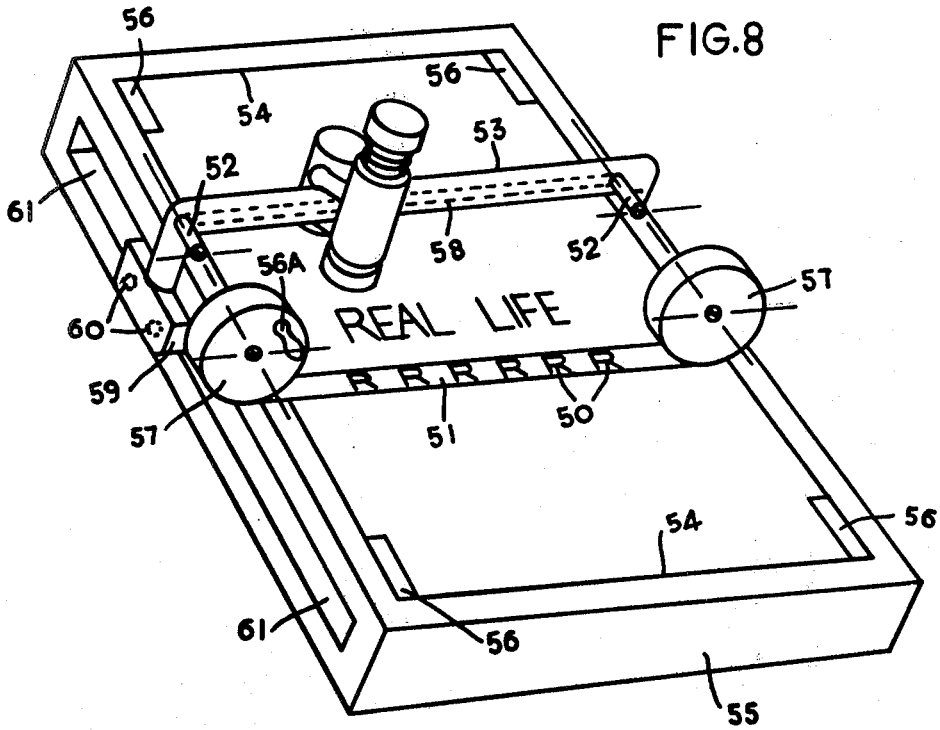
FIG.8
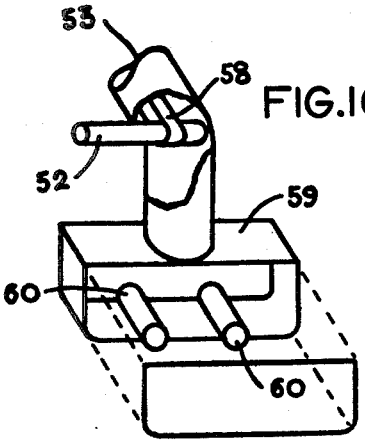
FIG.10
FIG.9
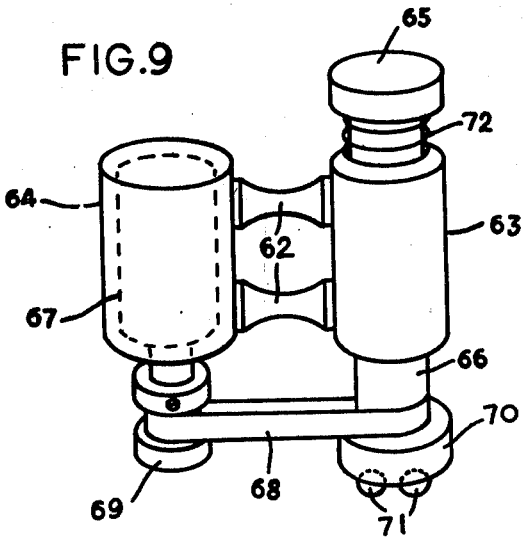

METHOD AND MACHINE FOR DRY CHARACTER TRANSFER

The present invention relates to a machine method of transferring characters from a tape or the like to an object.

BACKGROUND OF THE INVENTION

Artists, designers, draftsman, architects, and printers, etc., have long been using dry transfer sheets for fine quality graphics and for economical reasons. However, using these transfer sheets can be very tedious and slow, especially when making lines of copy. One must continually move and place a dry transfer sheet or tape over an object such as a paper sheet, while holding it down by hand, in such a way that the character or symbol is in exact registration every single time. Also, considerable time and caution must be paid when using the implement to rub on the top surface of the transfer sheet to insure proper and complete transfer of each character.

OBJECTS AND ADVANTAGES OF THE INVENTION

The object of the invention is to provide a machine for effecting the dry transferring of specific ink designs, symbols, patterns, indicia, and characters forming the alphabet, from a tape to the surface of an object such as a flat sheet of paper, cellophane, plastic, etc.

It is also the object of the invention to provide a means for moving the dry transfer tape back and forth over an object or sheet, thereby, giving quick and easy selection of characters or symbols from said tape.

A further object of the present invention is to provide a rubbing means which is applied to the dry transfer tape and thus bringing about the dry transferring of characters to the surface of said sheet almost instantly.

Another object of the invention is to provide a means for securing an object or sheet so that exact registration of a character to be transferred on said sheet can take place every time.

In general the invention relieves the operator of the need to constantly move, hold, and place presently used dry transfer sheets over a sheet to produce or print lines of copy for advertising layouts.

For further understanding of the invention, and of the objects and advantages thereof, a detailed description of two embodiments of the invention with accompanying drawings is set forth.

BRIEF DESCRIPTION OF DRAWINGS

FIG. 1 is a schematic view of spool wheels and tape reels showing the dry transfer characters printed on the tape.

FIG. 2 is a perspective view of one embodiment of the entire machine.

FIG. 8 is a perspective view of a second embodiment of the entire machine.

FIG. 9 is an isometric view of the rubbing means apparatus.

FIG. 10 is an isometric view of the end section of carriage, with cut out, showing reel shaft and belt, and inside of truck showing rollers.

DETAILED DESCRIPTION

Figure 3:
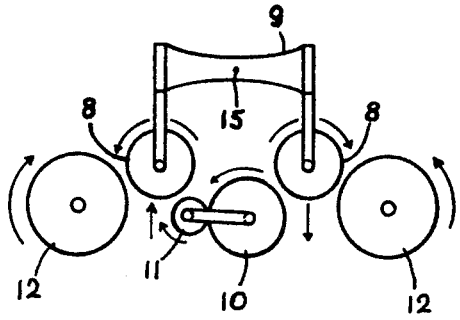
FIG. 3 is a face view of apparatus with rollers, motor shaft, and spool wheels.
Figure 3A:
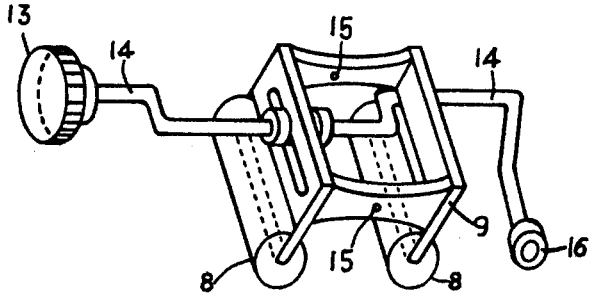
FIG. 3A is an isometric view of apparatus with rollers and control knob attached to crank shaft rod with small roller at its end.
Figure 4:
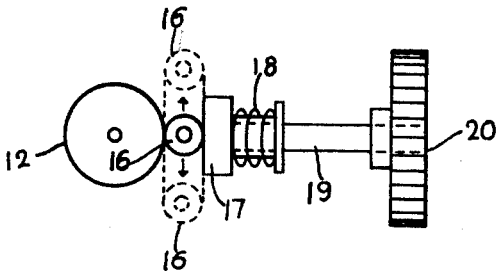
FIG. 4 is a side view of the control knob shown in FIG. 2 on the right side of machine spring, friction wheel attached to its end rod, and small roller between friction wheel and spool wheel.
Figure 5:
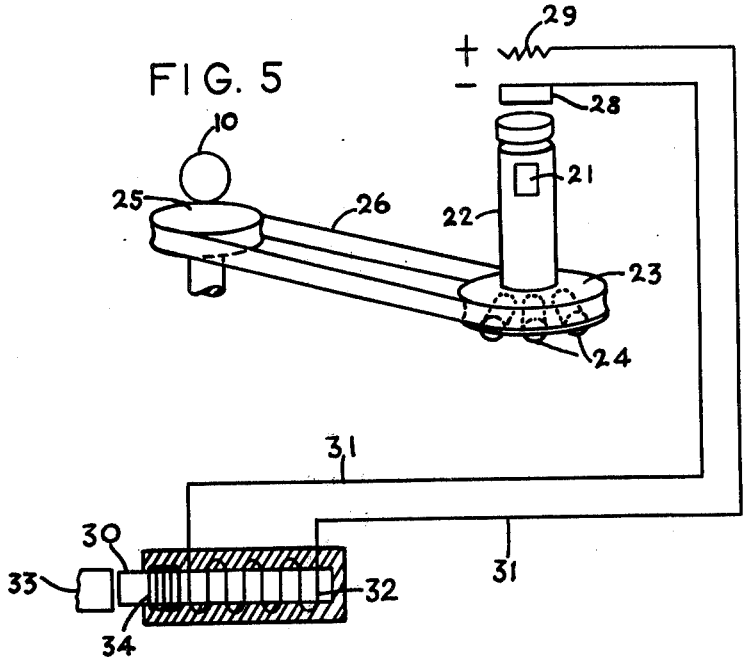
FIG. 5 is an isometric view of a rod coiled by electric wire (cross section of); partial view of lever in front of rod and a flexible belt which connects motor shaft, friction wheel and shaft with rubbing means attachment.
Figure 6:
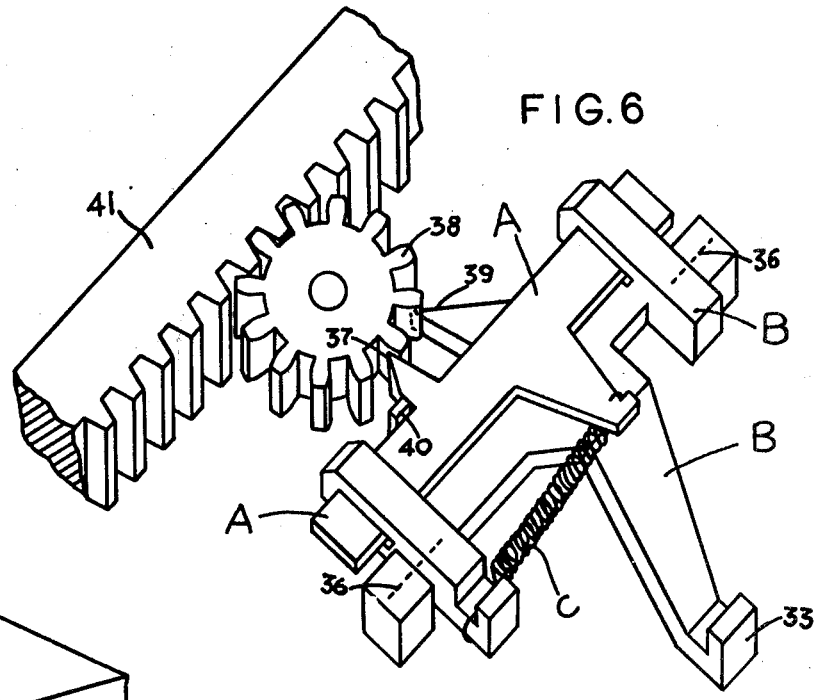
FIG. 6 is an isometric view of lever with spur gear and rack.
Figure 7:
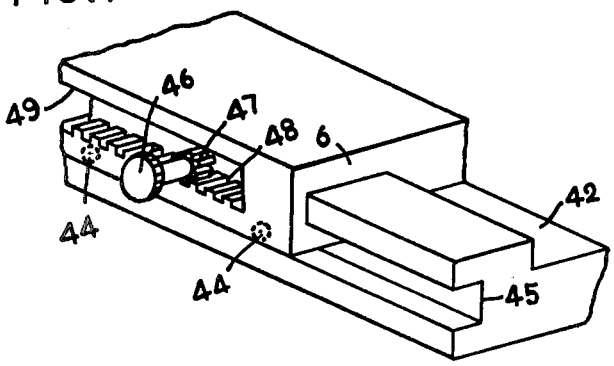
FIG. 7 is an isometric view of plate grooves, small wheels, rack and pinion attached to knob.

To simplify matters I am going to use a commercially sold tape, manufactured to specification, with dry transfer characters forming the alphabet and its punctuation marks. In FIG. 1 characters 2 of a specific typeface style, color, shape, and size shown from the top surface of tape 1 and printed on the bottom surface of said tape in reverse. The tape is inserted and locked in the spools 3 of FIG. 1 of machine by opening doors 4 in FIG. 2 located on each side of machine. It is to be understood that the tape will be in alphabetical order, that is, x number of capital A's, followed by x number of small a's and so forth. A flat sheet of paper 5 with a smooth surface, or another material other than paper, such as, plastic or cellophane, is placed on plate 6 so that the movable frames 7 will hold it firmly and squarely in relation to the tape 1. The tape can be moved in one direction from letter A to letter Z or vice versa from Z to A at a reasonably high speed. FIG. 3 shows two rubber rollers 8 rotatably mounted on frame 9, motor shaft 10 with smaller roller 11 permanently attached to it, and two flat spool wheels 12. As left knob 13 in FIG. 3A is turned counter clockwise, its crankshaft rod 14 will tilt the left side of frame 9 around a pivot point 15, upwards. This will cause the right roller 8 to descend and contact motor shaft 10 and spool wheel 12. This results in movement of tape in one direction. When knob 13 is turned clockwise, the left side of frame 9 will then descend with its other roller 8 contacting smaller roller 11 attached to motor shaft 10 and other spool wheel 12, thus, bring about movement of tape in the opposite direction. When tape is not moving, frame 9 will be in a neutral position in relation to motor shaft 10. A small rubber wheel or roller 16 is attached at the end of crankshaft rod 14 which has an upper, a lower and central or neutral positions (FIG. 4) and when in neutral position said roller 16 may be pressed by spring 18 against spool wheel 12, as seen in FIG. 4, by friction wheel 17 which is slidably mounted on rod 19 of knob 20. The wheel 17 is pushed horizontally by the spring 18 against smaller roller 16, thereby, drivingly connecting right spool wheel 12 and friction wheel 17. Rotating knob 20 will result in any chosen amount of movement of tape in either direction. The above gives the advantage of adjusting tape so that a desired character 2 will be in exact registration with sheet paper 5. A small lever or button 21 in FIG. 5 is attached to shaft 22 to enable it to be pushed downwardly. Shaft 22 has a flat, rotatable wheel 23 and small cylindrical rollers 24 emerging slightly from its lower surface. Shaft wheel 23 is connected to motor shaft 10 by means of flexible belt 26 to friction wheel 25, which, in turn, rotates shaft wheel 23. Upon contact of small cylindrical rollers 24 on upper surface of tape which in turn contacts sheet 5, a light pressure on level 21 is exerted by hand or other means, thereby, causing the character "F" to transfer from tape to the surface of the sheet paper 5. A blank spot left on the tape indicates total transfer of said character has taken place. As button 21 is released, piston 22, travels upwards and touches electrical contact 28 immediately above its upper surface. The electrical contact 28 will send current in reduced voltage, by resistor 29, to a rod 30, wrapped in a coil 32 by the electrical wire 31. When receiving the current, the rod 30 becomes magnetized, therefore, pushes against lever 33 in front of it. When current stops flowing, the rod 30 is de-magnetized and goes back by means of spring 34 to original position. This is commonly known as a solenoid switch. If one wishes to move entire plate 45 from right to left without having to print any characters, another button 35 in FIG. 2 operating the solenoid switch will release said plate. This results in automatic spacing between characters and also controls any amount of space between characters by the means now to be described. Referring to FIG. 6, lever 33 is comprised of three parts, A and B, and spring C. A lies above upper surface of B, which has a tooth 37 that is engaged between the teeth of spur gear 38 and stopper 40. B has another tooth 39 which is normally below the plane gear 38 and small stopper 40, which protrudes above B's surface. As magnetized rod 30 pushes against lever of part B, 33, tooth 39 goes upwards on pivot points 36 and between teeth of spur gear 38. Simultaneously, tooth 37 moves also upwards allowing one dent of spur gear 38 to pass under it, in clockwise motion. Spring C will keep dent 37 against stopper 40 at all times. As lever 33 is released tooth 39 moves downwards thereby disengaging with spur gear 38 and tooth 37 becomes again engaged to spur gear 38. Spur gear 38 is attached to plate 42 in FIG. 7 and acts as the pinion and 41 as the rack. In this manner, entire plate comprised of 6 and 42 will move from right to left a small step. The two tracks 43 are used to support and facilitate motion of entire plate. Going back to FIGS. 5 and 6, it is apparent that every time button 21 is pushed downwardly, a character, such as "F" is transferred and a word such as "FLY," can be formed. In FIG. 7 plate 6 sits flatly above plate 42 and moves to and fro by means of small wheels 44 located between grooves 45 of plate 42 and small knob 46 with gear attached to its shaft 47 engaged to rack 48 in slot 49 of plate 6. This movement to and fro is used to print other lines of words. ie., FLY and FIRE.

In FIG. 8 characters 50 of a specific typeface, style, color, and size, shown from the top surface of the dry transfer tape 51, and printed on the bottom surface of said tape in reverse. The tape is inserted and locked in reel shafts 52 located toward the ends of carriage 53. It is to be understood that the tape will be printed in alphabetical order, that is an X number of capital A's, followed by an X number of small a's and so forth.

A flat sheet of paper 54 with a smooth surface or another material other than paper, such as, plastic or cellophane, is placed on support means 55 so that holding means such as metal clips 56 will hold it firmly and squarely in relation to the tape 51.

Said tape can be moved back and forth over said sheet 54 by turning crank shaft 56A attached to tape reel 57. The reel shafts 52, as seen in FIG. 10, are driven by a belt 58 which does the actual movement of the tape and produces little or no tension on the tape itself. It is also to be understood that said tape 51 can also be power-driven in either direction by a motor shaft acting as one of the reel shafts 52.

Once a character such as "R" has been chosen and a desired place on the sheet 54 has been selected, then, carriage 53 is moved toward said place on said sheet by means of a roller truck 59 located on each end of carriage 53. Said truck 59 has two wheel attachment 60 placed (or inserted) on the base of the grooved 61 portion of support plate 55.

Then, the rubbing means apparatus, in FIG. 9, which is mounted over carriage 53 is moved across and along said carriage 53 by means of support rollers 62, attached to housing 63 and motor housing 64, to a desired place on the work sheet 54.

A light pressure is exerted on the finger piece 65 which is attached to a rotatable shaft 66 which is power-driven by motor 67 by means of a resilient belt 68 connected to motor shaft pulley 69 and said shaft 66.

As said finger piece 65 is being pushed downwardly and in a vertical direction, rubbing means wheel 70 with rollers 71, will contact the other side of the dry transfer tape 51 opposite the chosen character "R" with the surface of sheet 54, thereby, said character "R" is dry transferred to the surface of said sheet 54.

Upon release of finger piece 65, spring 72 will push it upwardly to its original position. Thus, by merely pushing down and releasing finger piece 65, the dry transferring is completed. Also the characters may be properly registered on working sheet 54.

It is to be understood that while the rubbing of the dry transfer tape is taking place, said tape, carriage, and sheet, are not moving. The only part that is moving during the actual transferring is the rubbing means.

The movement of the rubbing means apparatus across and over working sheet, and the carriage movement toward and away from said working sheet, a character can be dry transferred on any portion of working sheet, each time, in perfect registration. A word or words such as real, life, or lines of copy and or printed matter can thus be formed and used by printers, artists, and the like for advertising layouts.

The invention has been described and illustrated in connection with certain specific embodiments, but those skilled in the art will recognize that variations and modifications may be made without departing from the invention as described, and such variations and modifications are contemplated as being within the scope of the appended claims.

Having thus described the invention, what is claimed is:

1. A machine for effecting the dry transfer of characters from a tape bearing on one side at least one character capable of being transferred to an object by rubbing the other side of said tape opposite the character to be transferred while said character is in contact with said object which comprises:

(a) Means adapted for holding a reel of such tape and for moving it back and forth over an object to receive the transfer of a character therefrom with said one side facing said object, (b) Means for positioning an object to receive a character from said tape, and (c) Means for effecting the transfer of selected characters from the tape to the object comprising a rotary drive member, a plurality of rollers mounted in operative relation to said drive member for rotation in a plane parallel to the plane of said object and said tape.

2. A machine for effecting the dry transfer of selected characters from a tape bearing a plurality of characters capable of being transferred to a sheet by rubbing the other side opposite each selected character to be transferred while the selected character is in contact with said sheet which comprises:

(a) means adapted for positioning a sheet in proper relation to said machine to receive characters by transfer from such a tape;

(b) reel holding means adapted for rotatably mounting in spaced relation a take up reel and a supply reel for tape bearing such characters and for positioning a sequence of selected characters over selected areas of said sheet; and (c) means for effecting the transfer of selected characters, one character at a time, from said tape to a sheet by contacting the tape on the side opposite a character with transferring action localized to the area of the tape between the characters adjacent to the one being transferred.

3. A machine as set forth in claim 2 in which said sheet holding means is mounted for movement in relation to said rubbing means to position a selected portion of said sheet under said rubbing means.

4. A machine as set forth in claim 3 in which said sheet holding means is mounted for rectangular movement parallel and at right angles to a tape in said reels.

5. A machine as set forth in claim 3 in which said rubbing means is mounted for movement above and across a sheet on said sheet holding means.

6. A machine as set forth in claim 2 in which said reel holding means includes a reversible drive for each reel to enable an operator to position selected characters under said rubbing means.

7. A machine as set forth in claim 6 in which said drive is manually operated.

8. A machine as set forth in claim 6 in which said drive is power operated.

9. A machine as set forth in claim 2 in which said rubbing means is mounted for reciprocal movement toward and away from said sheet holding means.

10. A machine as set forth in claim 9 in which the reciprocal movement of said rubbing means is manually operated.

11. A machine as set forth in claim 9 in which the reciprocal movement of said rubbing means is power operated.

12. A machine as set forth in claim 9 in which said rubbing means comprises a rotor having a lower surface including a plurality of rollers rotatable mounted thereon adapted to engage the adjacent side of a tape held in said reels.

13. A machine for effecting the dry transfer of selected characters from a tape bearing a plurality of characters capable of being transferred to a sheet by rubbing the other side opposite each selected character to be transferred while the selected character is in contact with said sheet which comprises:

(a) a frame;

(b) a sheet holding means;

(c) means for mounting said sheet holding means on said frame for movement in two dimensions of a plane;

(d) a rubbing means comprising a plurality of rollers mounted for rotation in a plane parallel to the plane of a sheet on said sheet holding means, said rubbing means being mounted on said frame above and adapted for movement toward and away from said sheet holding means;

(e) resilient means for urging said rubbing means to raised position;

(f) means for moving said rubbing means to lowered rubbing position against the force of said resilient means into contact with the side of a tape opposite a character to be transferred;

(g) means for movably mounting a tape bearing characters on one side capable of being transferred therefrom to a sheet by said rubbing means, said tape being located between said rubbing means and said sheet holding means with the side bearing said characters toward the sheet holding means; and (h) means for moving said tape to locate a succession of characters over selected parts of a sheet on said sheet holding means.

14. A machine for effecting the dry transfer of selected characters from a tape bearing a plurality of characters capable of being transferred to a sheet by rubbing the other side opposite each selected character to be transferred while the selected character is in contact with said sheet which comprises:

(a) a sheet holding means;

(b) a carriage mounted for movement along said sheet holding means;

(c) a roller rubbing means comprising a plurality of rollers mounted for rotation in a plane parallel to a sheet on said sheet holding means, said rubbing means being mounted on said carriage for movement across said sheet holding means and toward and away from a sheet held thereon;

(d) means for normally holding said rubbing means in a position away from such a sheet;

(e) means for moving said rubbing means toward a sheet held on said sheet holding means;

(f) means for movably mounting a tape bearing characters on one side capable of being transferred therefrom to a sheet by said rubbing means, said tape being located between said rubbing means and said sheet holding means with the side bearing said characters toward the sheet holding means; and (g) means for moving said tape to locate a succession of characters over selected parts of a sheet on said sheet holding means.

15. A method of applying a plurality of dry transfer characters from a tape to an object which comprises:

(a) mounting the object for controlled movement in relation to a tape, (b) mounting the tape for controlled movement in relation to said object, (c) selectively moving the tape in relation to said object to position a selected first character on the tape over a selected first portion of said object, (d) rubbing the tape on the side opposite the first character by the action of a plurality of rollers rotating in a plane parallel to the plane of the sheet and tape to effect the transfer of the first character from the tape to the object, (e) moving the tape and the object relative to each other to position another selected character on the tape over another selected portion of said object, (f) rubbing the tape on the other side opposite the now positioned character by said action of a plurality of rollers to effect the transfer thereof to said object, and (g) repeating steps (e) and (f) until all the characters desired on said object have been transferred thereto from said tape.

16. A method of transferring from a tape bearing a plurality of different characters a sequence of selected characters to a sheet in straight lines which comprises:

(a) mechanically guiding a tape in a straight line across a sheet while holding the sheet and tape against relative movement along said sheet, (b) selecting the desired sequence of characters for transfer to said sheet by relative movement of the tape across the sheet, (c) transferring each selected character from the tape to the sheet in the desired location and sequence by the action of a plurality of rollers rotating in a plane parallel to the plane of said sheet and tape until a straight line of characters is completed, (d) moving said tape and said sheet lengthwise relative to each other to the position desired for another straight line of characters, (e) repeating steps (a), (b), and (c) until another straight line of characters is completed, and (f) repeating steps (d) and (e) until all the desired characters are transferred to said sheet in straight lines.

17. Apparatus for transferring from a tape bearing a plurality of different characters a sequence of selected characters to a sheet in straight lines which comprises:

(a) a tape bearing a plurality of different characters, (b) means for mounting a sheet to receive characters transferred from said tape, (c) means for mechanically guiding a tape across said sheet in a straight line while holding said sheet and tape against relative movement lengthwise of said sheet, (d) means for moving said tape to position a sequence of selected characters in proper position for transfer to said sheet along a straight line, (e) rubbing means to effect the transfer of said characters to said sheet comprising a plurality of rollers mounted for rotation in a plane parallel to the plane of said sheet and tape, and (f) means to move said tape and sheet in lengthwise relation for a succession of straight lines of character transfers by the aforesaid means (c), (d) and (e).

* * * * *